US011971038B2

(12) United States Patent
Xia et al.

(10) Patent No.: US 11,971,038 B2
(45) Date of Patent: Apr. 30, 2024

(54) SINGLE-STAGE ENTHALPY ENHANCING ROTARY COMPRESSOR AND AIR CONDITIONER HAVING SAME

(71) Applicant: GREE ELECTRIC APPLIANCES, INC. OF ZHUHAI, Qianshan Zhuhai (CN)

(72) Inventors: Guanghui Xia, Zhuhai (CN); Xiaocheng Lai, Zhuhai (CN); Shuo Xiong, Zhuhai (CN); Junchu Liang, Zhuhai (CN); Boming Zhu, Zhuhai (CN); Lihui Zhang, Zhuhai (CN); Wei Zhu, Zhuhai (CN); Xuechao Ding, Zhuhai (CN); Fuqiang Zhang, Zhuhai (CN); Hao Mei, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 0 days.

(21) Appl. No.: 17/935,407

(22) Filed: Sep. 26, 2022

(65) Prior Publication Data

US 2023/0018817 A1 Jan. 19, 2023

Related U.S. Application Data

(63) Continuation-in-part of application No. PCT/CN2020/126396, filed on Nov. 4, 2020.

(30) Foreign Application Priority Data

Mar. 31, 2020 (CN) ..... 202010242762.8

(51) Int. Cl.
*F04C 29/04* (2006.01)
*F04C 18/356* (2006.01)
(Continued)

(52) U.S. Cl.
CPC ..... *F04C 29/042* (2013.01); *F04C 18/3562* (2013.01); *F04C 18/3564* (2013.01);
(Continued)

(58) Field of Classification Search
CPC ..... F04C 2/22–46; F04C 18/22–46; F04C 29/0007; F04C 29/042; F04C 15/06–068; F04C 29/12–128
See application file for complete search history.

(56) References Cited

U.S. PATENT DOCUMENTS

2015/0040608 A1* 2/2015 Nam ..... F04C 18/356 418/63

FOREIGN PATENT DOCUMENTS

CN 101586562 A * 11/2009
CN 101608621 A * 12/2009
(Continued)

OTHER PUBLICATIONS

International Search Report dated Jan. 28, 2021, issued in International Application No. PCT/CN2020/126396, filed Nov. 4, 2020, 3 pages.

(Continued)

*Primary Examiner* — Laert Dounis
(74) *Attorney, Agent, or Firm* — Christensen O'Connor Johnson Kindness PLLC

(57) ABSTRACT

A single-stage enthalpy enhancing rotary compressor and an air conditioner having same. The single-stage enthalpy enhancing rotary compressor includes: at least one single-stage cylinder, a rotator, an upper flange, and a lower flange. The rotator is arranged inside the cylinder and is rotatable, a compression chamber is formed between the rotator and an inner peripheral wall of the cylinder, a vapor injection opening is defined in at least one of the upper flange the lower flange, and the vapor injection opening is configured
(Continued)

to supply gas outside the compressor to the compression chamber directly. According to the present disclosure, two-stage compression is realized without adding an extra cylinder, thereby effectively enhancing a circulation of refrigerant, improving cooling performance of the air conditioner under high environmental temperatures.

11 Claims, 6 Drawing Sheets

(51) Int. Cl.

| | |
|---|---|
| ***F04C 29/00*** | (2006.01) |
| ***F04C 29/12*** | (2006.01) |
| ***F25B 13/00*** | (2006.01) |
| ***F25B 31/02*** | (2006.01) |

(52) U.S. Cl.
CPC ..... *F04C 29/0007* (2013.01); *F04C 29/12* (2013.01); *F25B 13/00* (2013.01); *F25B 31/026* (2013.01); *F04C 2240/20* (2013.01); *F25B 2400/13* (2013.01); *F25B 2400/23* (2013.01)

(56) References Cited

FOREIGN PATENT DOCUMENTS

| | | | | | |
|---|---|---|---|---|---|
| CN | 201666251 | U | * | 12/2010 | |
| CN | 102364107 | A | | 2/2012 | |
| CN | 106979155 | A | | 7/2017 | |
| CN | 107401511 | A | | 11/2017 | |
| CN | 207178220 | U | | 4/2018 | |
| CN | 108730181 | A | | 11/2018 | |
| CN | 108800384 | A | | 11/2018 | |
| CN | 111502990 | A | | 8/2020 | |
| JP | 2012093017 | A | * | 5/2012 | |
| JP | 2012093017 | A | | 5/2012 | |
| WO | WO-2008072575 | A1 | * | 6/2008 | ..... F01C 1/322 |
| WO | 2019/029264 | A1 | | 2/2019 | |
| WO | WO-2020031248 | A1 | * | 2/2020 | ..... F04C 18/356 |

OTHER PUBLICATIONS

Extended European Search Report dated Aug. 8, 2023, issued in European Application No. EP20926814, filed Nov. 4, 2020, 5 pages.

* cited by examiner

SINGLE-STAGE ENTHALPY ENHANCING ROTARY COMPRESSOR AND AIR CONDITIONER HAVING SAME

CROSS-REFERENCE TO RELATED APPLICATIONS

The present application is a continuation-in-part application of PCT Patent Application No. PCT/CN2020/126396, entitled "Single-Stage Enthalpy Enhancing Rotary Compressor and Air Conditioner Having Same", filed on Nov. 4, 2020, which claims priority to Chinese Patent Application No. 202010242762.8, entitled "Single-Stage Enthalpy Enhancing Rotary Compressor and Air Conditioner Having Same", filed on Mar. 31, 2020, the entire contents of which are incorporated herein by reference.

TECHNICAL FIELD

The present disclosure relates to the technical field of air conditioners, in particular, to a single-stage enthalpy enhancing rotary compressor and an air conditioner having same.

BACKGROUND

For high-temperature regions such as the Middle East, the environmental temperature continues to be high throughout the year. During the use of the air conditioner, a temperature difference for heat exchange of the outdoor condenser is small due to the high environmental temperature, therefore the heat exchange effect is poor, and the cooling capacity is greatly attenuated. However, in the Middle East, the requirements for energy efficiency are getting higher and higher. In order to ensure the energy efficiency of an invariable-frequency product, the selection of the compressor displacement is greatly restricted. In order to improve the cooling effect under high temperature conditions, a two-stage compression compressor and an air-conditioning system having the same may be used. However, the existing two-stage compression compressor is only a variable-frequency compressor and uses two compressing cylinders to complete the two-stage compression. A cost of such a compressor is high. What's more, because the compression is performed by means of two cylinders at the same time, the power of the compressor is relatively high, thus resulting in a low energy efficiency.

When the air conditioner is applied to cool under a working condition of a relatively high environmental temperature, the temperature difference for the heat exchange of the air conditioner in the related art is small, thus resulting in poor heat exchange effect and low cooling performance. If the two-stage compression compressor and the air-conditioning system having the same are used to increase a compression ratio, the energy efficiency will be relatively low due to the relatively high power of the compressor. Moreover, the use of the variable-frequency compressor and the two-stage compressing cylinders will result in high cost and cause a technical problem of a complex structure, etc. Therefore, the present disclosure researches and designs the single-stage enthalpy enhancing rotary compressor and the air conditioner having the same.

SUMMARY

Therefore, the technical problem to be solved by the present disclosure is to overcome the defect that the air conditioner in the related art, when being applied to cool under a working condition of a relatively high environmental temperature, cannot guarantee the cooling performance and energy efficiency as well, so as to provide a single-stage enthalpy enhancing rotary compressor and an air conditioner having the same.

In order to solve the problem above, the present disclosure provides a single-stage enthalpy enhancing rotary compressor, which includes: at least one single-stage cylinder, a rotator, an upper flange, and a lower flange. The rotator is arranged inside the cylinder and is rotatable. A compression chamber is formed between the rotator and an inner peripheral wall of the cylinder. A vapor injection opening is defined in at least one of the upper flange and the lower flange, and the vapor injection opening is configured to supply gas outside the compressor to the compression chamber directly.

In some embodiments, when the rotator rotates to a first preset position range, the vapor injection opening is configured not to be blocked by the rotator and configured to be automatically opened. When the rotator rotates to a second preset position range, the vapor injection opening is configured to be blocked by the rotator and to be automatically closed. The first preset position range, together with the second preset position range, constitutes a position range of the rotator moving in a circle.

In some embodiments, the cylinder is provided with a sliding vane slot; and a rotation angle of the rotator is calculated from 0°, defined by a position where a sliding vane fully extends into the sliding vane slot, and the first preset position range is within a range of 135° to 345°, and the second preset position range is within a range of −15° to 135°.

In some embodiments, the cylinder is provided with a suction port, a gas discharging port, and a sliding vane slot. The suction port and the gas discharging port are located by two sides of the sliding vane slot, respectively. A position of the vapor injection opening is arranged and located at a side of the cylinder proximate to the suction port with respect to the gas discharging port.

In some embodiments, in a counterclockwise rotation direction towards the suction port, a position of the sliding vane slot is defined as a rotation angle of 0% and the vapor injection opening is disposed within a range from 67° to 87°.

In some embodiments, in a counterclockwise rotation direction towards the suction port, a position of the sliding vane slot is defined as a rotation angle of 0% and the vapor injection opening is disposed within a range from 83° to 103°.

In some embodiments, the suction port is configured to be closed after the vapor injection opening is fully opened.

In some embodiments, a diameter of the vapor injection opening is 2.5 mm or 3.0 mm.

In some embodiments, the single-stage enthalpy enhancing rotary compressor is an invariable-frequency compressor.

The present disclosure further provides an air conditioner, including any one of the single-stage enthalpy enhancing rotary compressors above, and further includes a condenser, an evaporator, a flash evaporator, and a first-stage throttling device. The first-stage throttling device is arranged in a pipeline between the condenser and the flash evaporator. The flash evaporator is provided with a gas output pipeline and a liquid output pipeline. The gas output pipeline is in communication with the vapor injection opening of the compressor, and the liquid output pipeline is in communication with the evaporator.

In some embodiments, the liquid output pipeline is further provided with a second-stage throttling device or a straight pipe, and/or an outlet of the compressor is further provided with a four-way valve.

The single-stage enthalpy enhancing rotary compressor and the air conditioner provided by the present disclosure have the following beneficial effects.

In the present disclosure, the intermediate vapor injection structure is provided in the flange based on the existing single-stage compressor, which can realize periodic vapor injection by means of the working characteristics of the existing rotary compressor, and realizes the two-stage compression without adding an extra cylinder, thereby effectively enhancing the circulation of the refrigerant, improving heat exchange performance of the evaporator under the high environmental temperatures, and improving the cooling performance of the air conditioner. Moreover, the increased power consumption caused by using a two-stage cylinder is reduced, thereby improving the energy efficiency of the system effectively, greatly reducing the cost and the power of the compressor, and achieving the objectives of high capacity, high energy efficiency and low cost. The present disclosure also adopts the invariable-frequency compressor, thus further reducing the power consumption of the compressor, improving the energy efficiency, and further reducing the cost. By means of the creative position arrangement of the vapor injection opening, the present disclosure enables the vapor injection opening not to be blocked by the rotator and to be automatically opened when the rotator rotates to the first preset position range, and enables the vapor injection opening to be blocked by the rotator and to be automatically closed when the rotator rotates to the second preset position range, thereby effectively realizing an automatic vapor injection function of the single-stage enthalpy enhancing compressor without providing a control valve and a main board additionally to control the intermediate vapor injection to be opened or closed. The vapor injection is more intelligent, the system control is easier, and the cost is lower.

Figure 1:
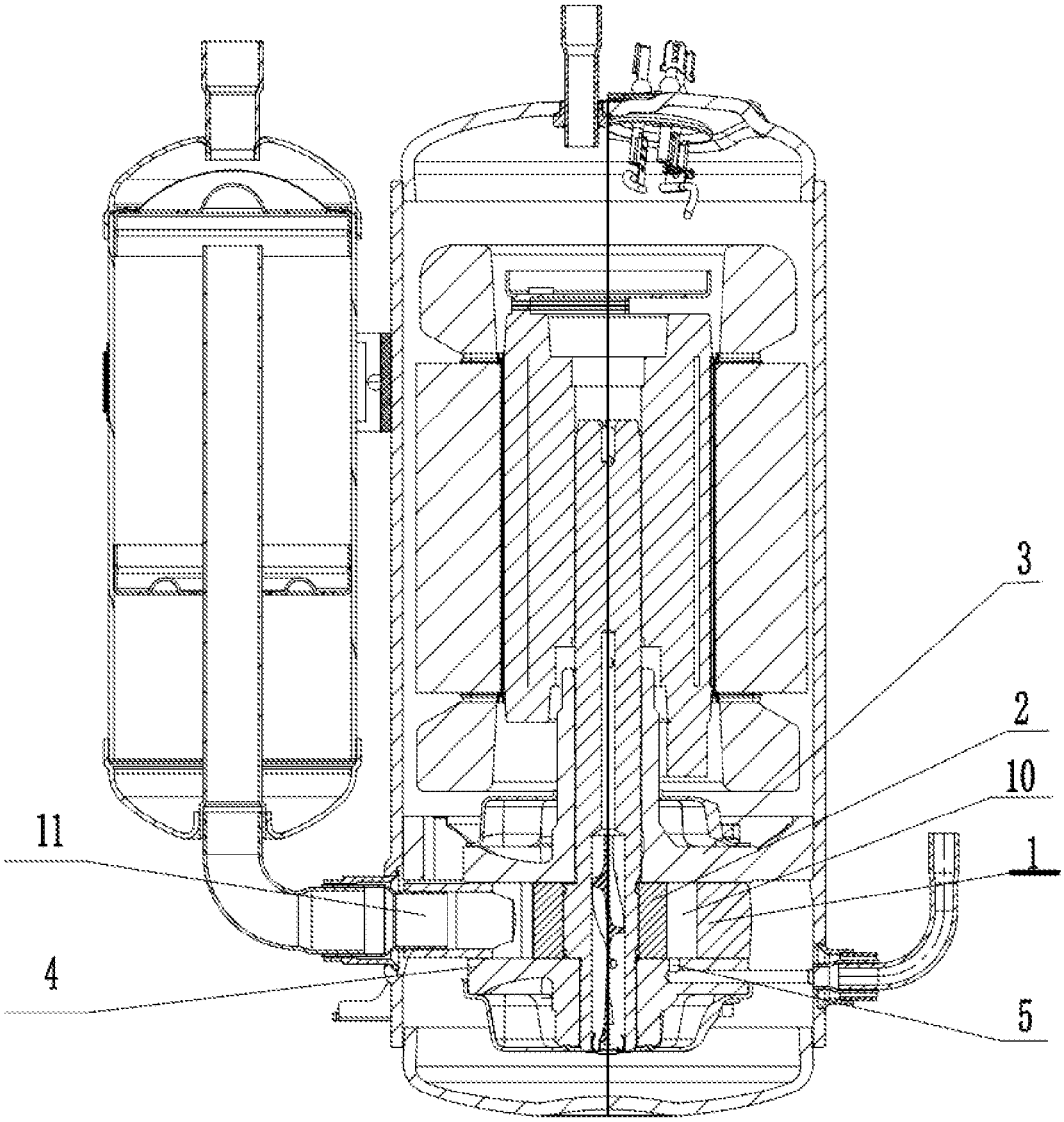
FIG. 1 is a longitudinal sectional view showing a vapor injection opening, corresponding to a position on a cylinder and defined in a lower flange inside a single-stage enthalpy enhancing rotary compressor of an embodiment of the present disclosure.
Figure 2:
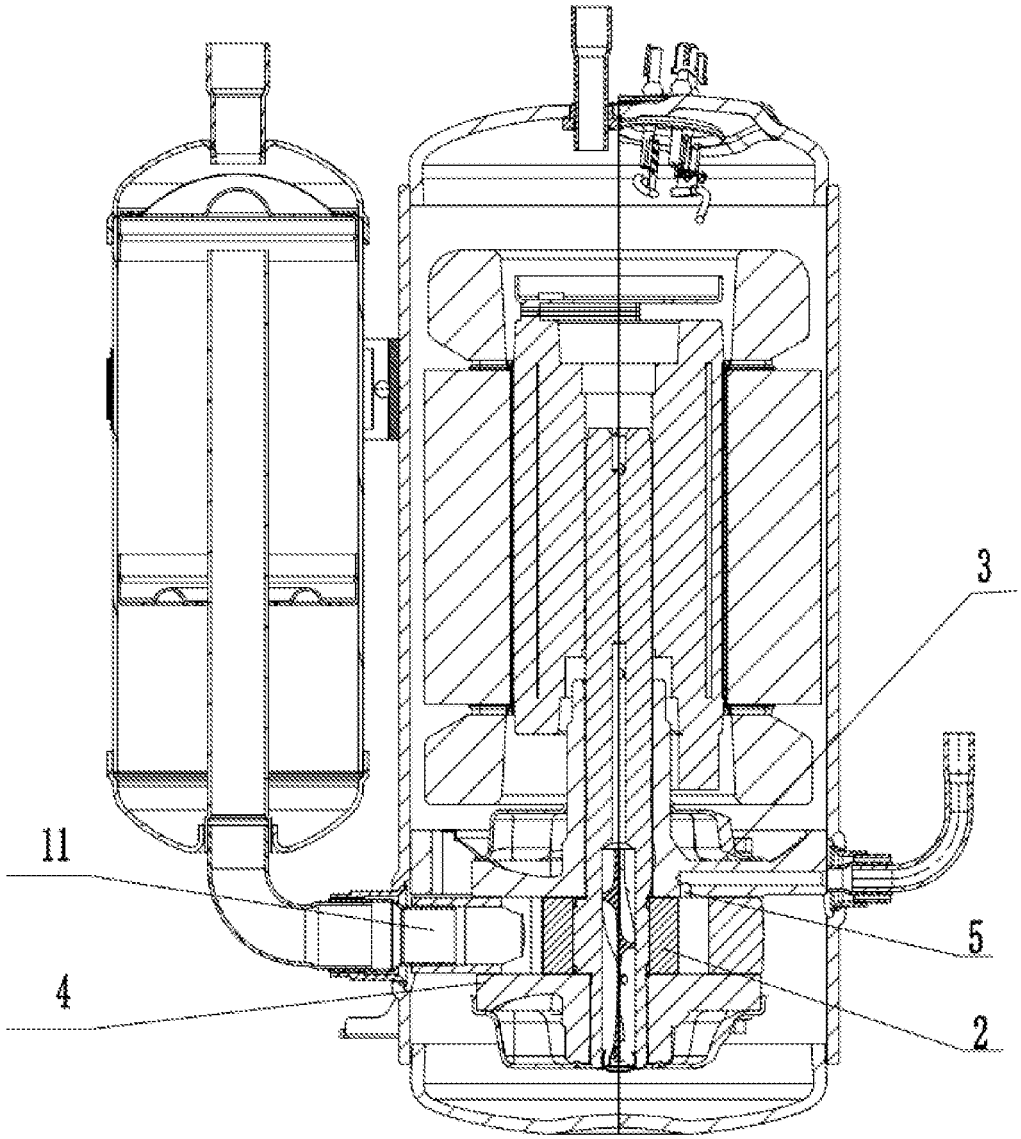
FIG. 2 is a longitudinal sectional view showing the vapor injection opening, corresponding to a position on the cylinder and defined in an upper flange inside the single-stage enthalpy enhancing rotary compressor of an embodiment of the present disclosure.

Reference numerals are indicated as:

1, cylinder; 10, compression chamber; 11, suction port; 12, gas discharging port; 13, sliding vane slot; 2, rotator; 3, upper flange; 4, lower flange; 5, vapor injection opening; 6, condenser; 7, evaporator; 8, flash evaporator; 81, gas output pipeline; 82, liquid output pipeline; 91, first-stage throttling device; 92, second-stage throttling device; 93, straight pipe; 200, four-way valve; 100, compressor; 101, vapor injection reservoir.

DETAILED DESCRIPTION OF THE EMBODIMENTS

Figure 10:
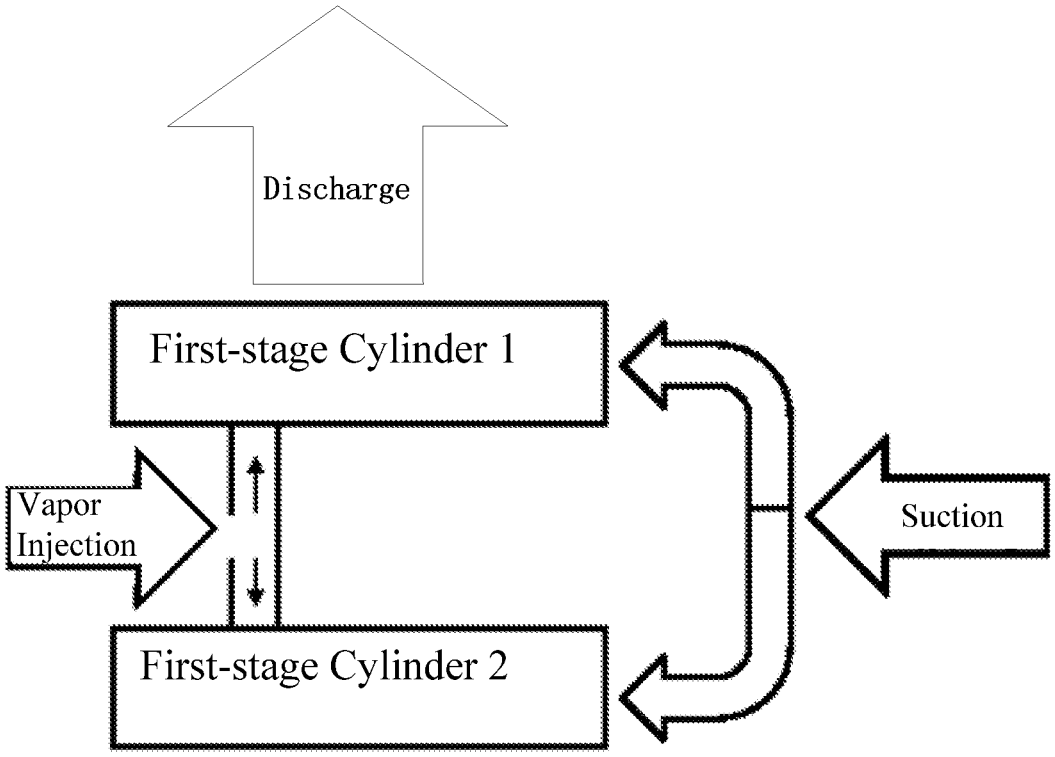
FIG. 10 is a flow chart showing the vapor injection of two single-stage cylinders in the single-stage enthalpy enhancing rotary compressor of the present disclosure.

As shown in FIG. 1-5, the present disclosure provides a single-stage enthalpy enhancing rotary compressor, which includes at least one single-stage cylinder 1 (the single-stage cylinder refers to a cylinder of which compression stage is a single stage rather than a multiple stage, including such as one single-stage cylinder, or two or more parallel single-stage cylinders, as shown in FIG. 10, there are two parallel single-stage cylinders), a rotator 2, an upper flange 3, and a lower flange 4. The rotator 2 is arranged inside the cylinder 1 and is rotatable. A compression chamber 10 is formed between the rotator 2 and an inner peripheral wall of the cylinder 1. A vapor injection opening 5 is defined in the upper flange 3 and/or the lower flange 4, and the vapor injection opening 5 may supply the gas outside the compressor to the compression chamber 10 directly.

In the present disclosure, the intermediate vapor injection structure is provided in the flange based on the existing single-stage compressor, which can realize periodic vapor injection by means of the working characteristics of the existing rotary compressor, and realizes the two-stage compression without adding an extra cylinder, thereby effectively enhancing the circulation of the refrigerant, improving the heat exchange performance of the evaporator under high environmental temperatures, and improving the cooling performance of the air conditioner. Moreover, the increased power consumption caused by using a two-stage cylinder is reduced, thereby improving the energy efficiency of the system effectively, greatly reducing the cost and the power of the compressor, and achieving the objectives of high capacity, a high energy efficiency and a low cost. The present disclosure also adopts the invariable-frequency compressor, thus further reducing the power consumption of the compressor, improving the energy efficiency, and further reducing the cost. In the present disclosure, the intermediate vapor injection structure is provided on the basis of the existing single-stage compressor to realize two-stage compression, which can not only solve the problem of high cost of the compressor, but also avoid the problem of low energy efficiency caused by a large increase in power.

In some embodiments, when the rotator 2 rotates to a first preset position range, the vapor injection opening 5 may not be blocked by the rotator and is automatically opened. When the rotator 2 rotates to a second preset position range, the vapor injection opening 5 may be blocked by the rotator and is automatically closed. The first preset position range, together with the second preset position range, constitutes the position range of the rotator moving in a circle.

By means of the creative position arrangement of the vapor injection opening, the present disclosure enables the vapor injection opening not to be blocked by the rotator and to be automatically opened when the rotator rotates to the first preset position range, and enables the vapor injection opening to be blocked by the rotator and to be automatically closed when the rotator rotates to the second preset position range, thereby effectively realizing the automatic vapor injection function of the single-stage enthalpy enhancing compressor without providing a control valve and a main board additionally to control the intermediate vapor injection to be opened or closed. The vapor injection is more intelligent, the system control is easier, and the cost is lower.

The difficulty in choosing to process the vapor injection opening in the single-stage cylinder is that it needs to be considered at which angle the vapor injection starts during the rotation of the rotator, and under which pressure condition the vapor injection is automatically closed by means of the rotation of the rotator. There is no need to provide an opening in the rotator. In terms of the effects, the single-stage compressor, under the high temperature refrigeration conditions, has the same performance as the two-stage or multiple-stage compression unit, but has a higher energy efficiency due to a low power. Therefore, the single-stage enthalpy enhancing compressor is more applicable for high temperature areas. Moreover, because only one-stage compression is needed, the cost is much lower.

In some embodiments, the cylinder 1 is provided with a sliding vane slot 13, and the rotation angle of the rotator is calculated from 0°, defined by a position where the sliding vane fully extends into the sliding vane slot, and the first preset position range is within the range of 135° to 345°, and the second preset position range is within the range of −15° to 135°. The preferred position and the arrangement of the vapor injection opening 5 of the present disclosure is that, when the rotator rotates to the first preset position range of 135° to 345°, the rotator does not block the vapor injection opening 5, so that the vapor injection opening 5 is automatically opened and the vapor injection is opened, and when the rotator rotates to the second preset position range of −15° to 135°, the rotator blocks the vapor injection opening 5, so that the vapor injection opening 5 is automatically closed and the vapor injection is closed, thereby realizing an intelligent and automatic periodic vapor injection. The first preset position range and the second preset position range add up to a full circle of 360°.

Figure 4:
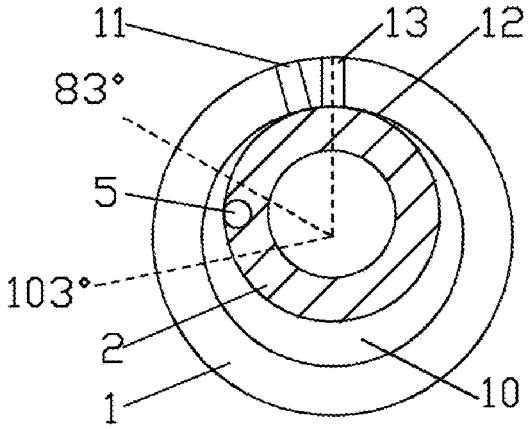
FIG. 4 is a transverse sectional view showing the vapor injection opening, corresponding to the position on the cylinder and defined in the upper flange inside the single-stage enthalpy enhancing rotary compressor of another embodiment of the present disclosure.
Figure 5:
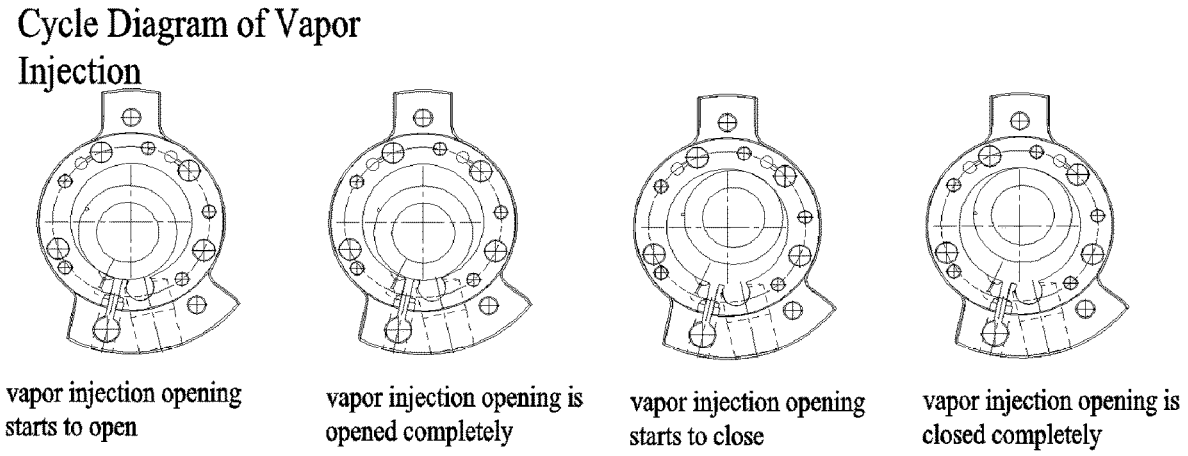
FIG. 5 shows a cycle diagram of vapor injection from the vapor injection opening of the upper flange in FIG. 4 (when the compressor is operating).

In some embodiments, the cylinder 1 is provided with a suction port 11, a gas discharging port 12, and a sliding vane slot 13. The suction port 11 and the gas discharging port 12 are located by two sides of the sliding vane slot 13, respectively. A position of the vapor injection opening 5 is arranged and located at a side of the cylinder 1 proximate to the suction port 11 with respect to the gas discharging port 12. In the present disclosure, the vapor injection opening is arranged in the low pressure region of the compressor, thus effectively avoiding the problem above, realizing the vapor injection function without increasing the pressure of the flash evaporator, and achieving significant effects on performance improvement. Specifically, as shown in FIG. 4, in a counterclockwise rotation direction towards the suction port 11, a position of the sliding vane slot 13 is defined as a rotation angle of 0°, the vapor injection opening 5 is disposed within a range from 83° to 103°

Figure 3:
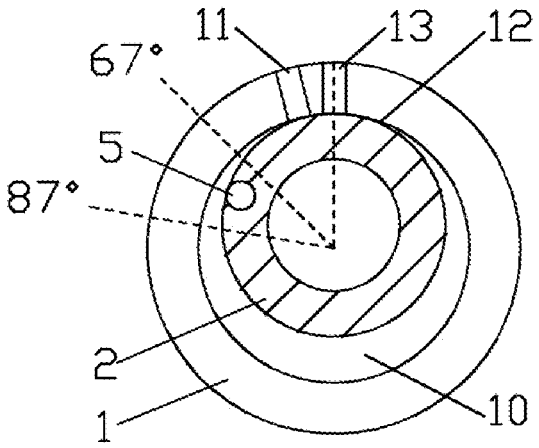
FIG. 3 is a transverse sectional view showing the vapor injection opening, corresponding to the position on the cylinder and defined in the upper flange inside the single-stage enthalpy enhancing rotary compressor of an embodiment of the present disclosure.

In some embodiments, as shown in FIG. 3, in a counterclockwise rotation direction towards the suction port 11, a position of the sliding vane slot 13 is defined as a rotation angle of 0°, the vapor injection opening 5 is disposed within a range from 67° to 87°. In some embodiments, the suction port 11 is closed after the vapor injection opening 5 is fully opened. In some embodiments, a diameter of the vapor injection opening 5 is 2.5 mm or 3.0 mm.

On the basis of the existing single-stage compressor, the intermediate vapor injection structure is provided, and the vapor injection opening is arranged in the upper flange of the compressor. The diameter of the vapor injection opening is 2.5 mm or 3 mm, and the position of the vapor injection opening is arranged in the low pressure area of the compressor and located within the range of 67° to 87° in the counterclockwise direction based on the sliding vane slot. The suction port needs to be closed after the vapor injection opening is fully opened, to ensure that there is no gas leakage or blowby. The difficulty in choosing to process the vapor injection opening in the single-stage cylinder is that it needs to be considered at which angle the vapor injection starts during the rotation of the rotator, and under which pressure condition the vapor injection is automatically closed by the rotation of the rotator. There is no need to provide an opening in the rotator. In terms of the effects, the single-stage compressor, under the high temperature refrigeration conditions, has the same performance as the two-stage or other multiple-stage compression unit, but has a higher energy efficiency due to the low power. Therefore, the single-stage enthalpy enhancing compressor is more applicable for the high temperature areas. Moreover, because only one-stage compression is needed, the cost is much lower.

In some embodiments, the single-stage enthalpy enhancing rotary compressor is an invariable-frequency compressor. The present disclosure uses the invariable-frequency compressor to further reduce the power consumption of the compressor, to improve the energy efficiency, and to further reduce the cost.

The present disclosure provides a completely new single-stage enthalpy enhancing invariable-frequency rotary compressor and the air-conditioning system having the same, which can achieve a substantial improvement in performance while maintaining a small increase in cost.

1. On the basis of the existing single-stage compressor, the intermediate vapor injection structure is provided, and the vapor injection opening is provided in the upper flange of the compressor, which can realize the periodic vapor injection by means of the working characteristics of rotator in the existing rotary compressor, and can realize the two-stage compression without adding an extra cylinder.
2. A first-stage throttling device is arranged at an exit of the condenser of the whole air-conditioning system. After the first-stage throttling device, a flash evaporator is arranged to separate the liquid refrigerant and the gas refrigerant. The gas refrigerant flows back into the compressor to increase the capacity of improving the flow rate of the system. The liquid refrigerant, after undergoing a flash evaporation, becomes subcooled liquid, flows through the second-stage throttling device, and enters the evaporator, thereby improving the heat exchange efficiency of the indoor unit.

3. On the whole air-conditioning system, the intermediate vapor injection is always opened under all working conditions, and no two-way valve and no main board are needed to control the intermediate vapor injection to be opened or closed.

Figure 6:
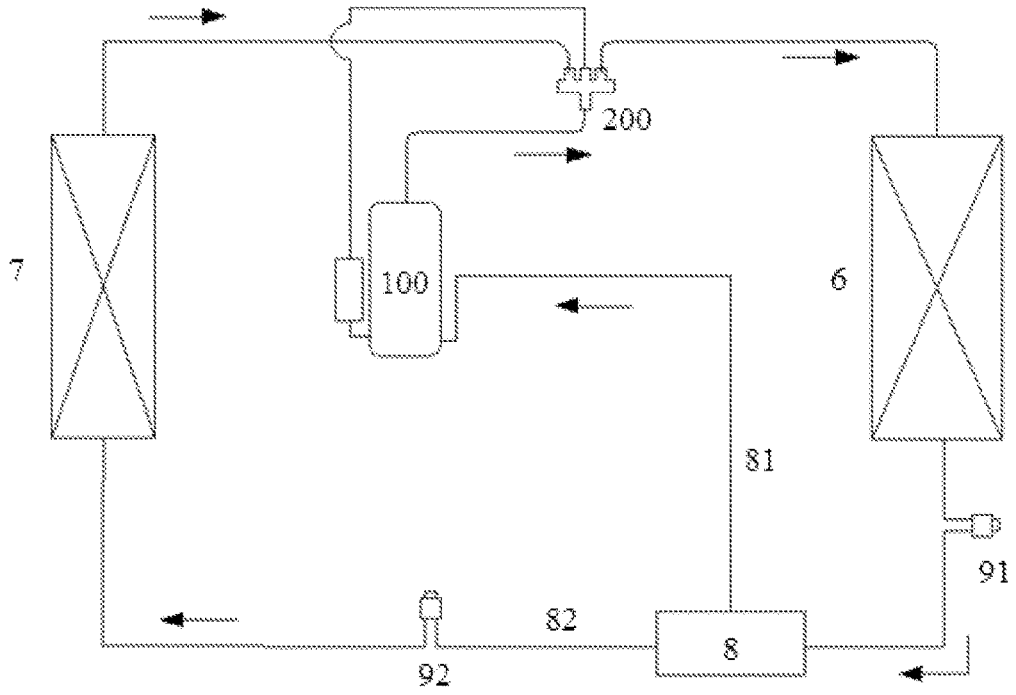
FIG. 6 is a circular system view showing an air conditioner having the single-stage enthalpy enhancing rotary compressor of the present disclosure.

As shown in FIG. 6, the present disclosure also provides an air conditioner having any one of the single-stage enthalpy enhancing rotary compressors described above, and further includes a condenser 6, an evaporator 7, a flash evaporator 8, and a first-stage throttling device 91. The first-stage throttling device 91 is arranged in the pipeline between the condenser 6 and the flash evaporator 8. The flash evaporator 8 is provided with a gas output pipeline 81 and a liquid output pipeline 82. The gas output pipeline 81 is in communication with the vapor injection opening 5 of the compressor, and the liquid output pipeline 82 is in communication with the evaporator 7.

The working principle of the system is as follows.

In a cooling mode, the high-temperature and high-pressure refrigerant discharged from the compressor 100 is cooled by the condenser 6, and then enters the first-stage throttling device 91 through the outlet of the condenser 6. After being throttled, the refrigerant becomes a high-pressure and low-temperature gas-liquid two-phase refrigerant, and then enters the flash evaporator 8. The liquid refrigerant and the gas refrigerant are separated in the flash evaporator 8. The gas refrigerant flows back into a suction chamber of the compressor 100. After the refrigerant in the suction chamber of the compressor 100 is compressed to a certain pressure, the vapor injection opening 5 is opened to realize vapor injection. When the mixed refrigerant is compressed to a higher pressure, the vapor injection opening 5 is closed, thereby increasing the capacity of improving the flow rate of the system. The liquid refrigerant in the flash evaporator 8, after undergoing a flash evaporation, becomes subcooled liquid, flows through the second-stage throttling device 92, and enters the evaporator 7. The second-stage throttling device 92 further lowers the temperature of the refrigerant, thereby increasing the cooling capacity of the system.

In a heating mode, the high-temperature and high-pressure refrigerant discharged from the compressor 100 is cooled by the evaporator 7, passes through an outlet of the evaporator 7 and then enters the second-stage throttling device 92. After being throttled, the refrigerant becomes a low-pressure and low-temperature gas-liquid two-phase refrigerant, and then enters the flash evaporator 8. The liquid refrigerant and the gas refrigerant are separated in the flash evaporator 8. The gas refrigerant flows back into the suction chamber of the compressor 100 to increase the capacity of improving the flow rate of the system. The liquid refrigerant, after undergoing a flash evaporation, becomes subcooled liquid, flows through the first-stage throttling device 91, and enters the condenser 6, and flows back to the compressor 100.

In some embodiment, the liquid output pipeline 82 is further provided with the second-stage throttling device 92 or a straight pipe 93, and/or a four-way valve 200 is arranged at the outlet of the compressor 100.

Figure 7:
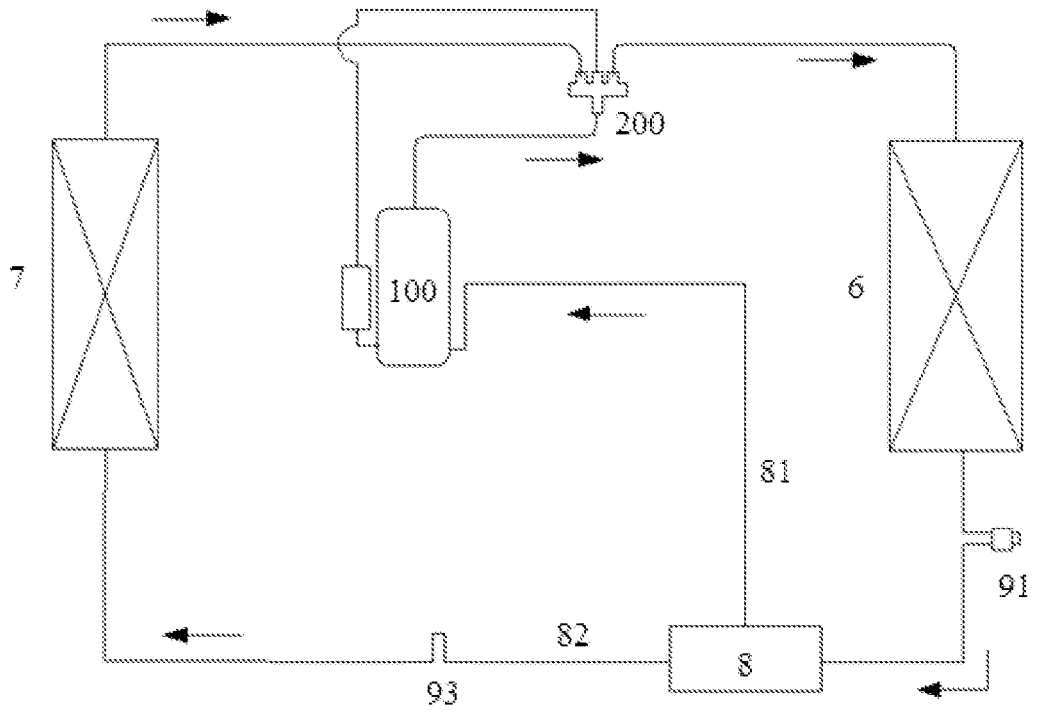
FIG. 7 is another circular system view showing a first alternative embodiment of the air conditioner having the single-stage enthalpy enhancing rotary compressor in FIG. 6.

In the first alternative embodiment, as shown in FIG. 7, in an actual use process, due to a large amount of and a fast speed of the intermediate vapor injection, in order to ensure the flow rate of the evaporator 7, the second-stage throttling device 92 of some systems may be replaced with a straight pipe 93. The system structure and the system principle are the same as those of the first solution. For some types of units needing a large amount of intermediate vapor injection, to ensure the throttling and pressure reduction effect, only the first-stage throttling device 91 is needed. In addition, due to the flash evaporation effect of the refrigerant in the flash evaporator 8, the liquid refrigerant in the flash evaporator 8 may be further subcooled.

Figure 8:
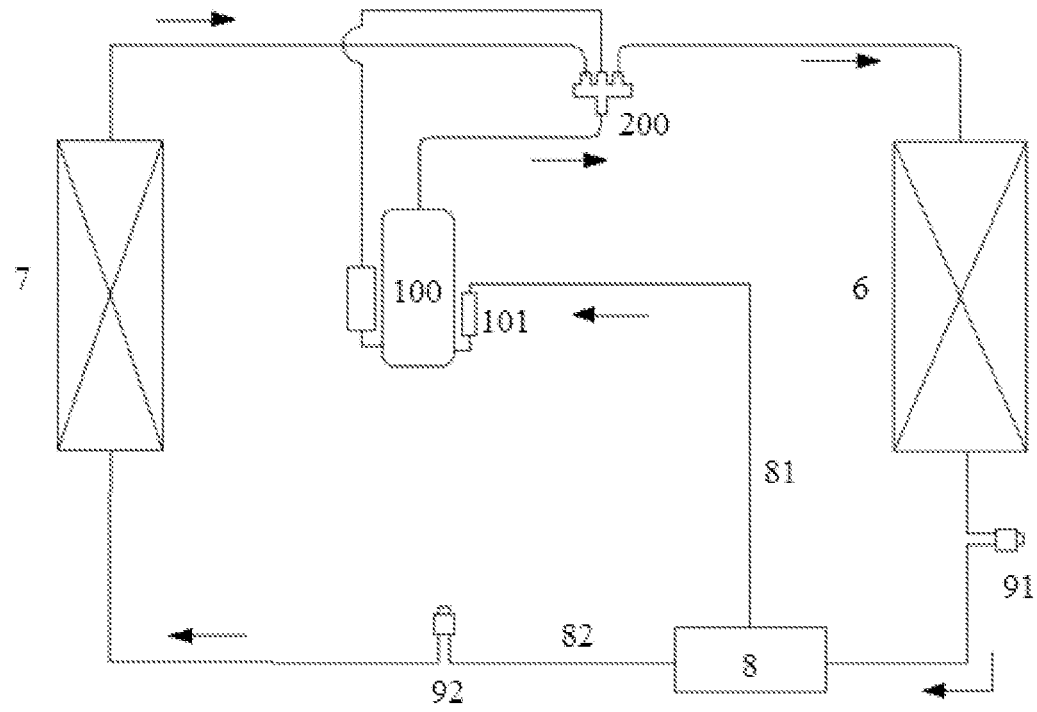
FIG. 8 is another circular system view showing a second alternative embodiment of the air conditioner having the single-stage enthalpy enhancing rotary compressor in FIG. 6.
Figure 9:
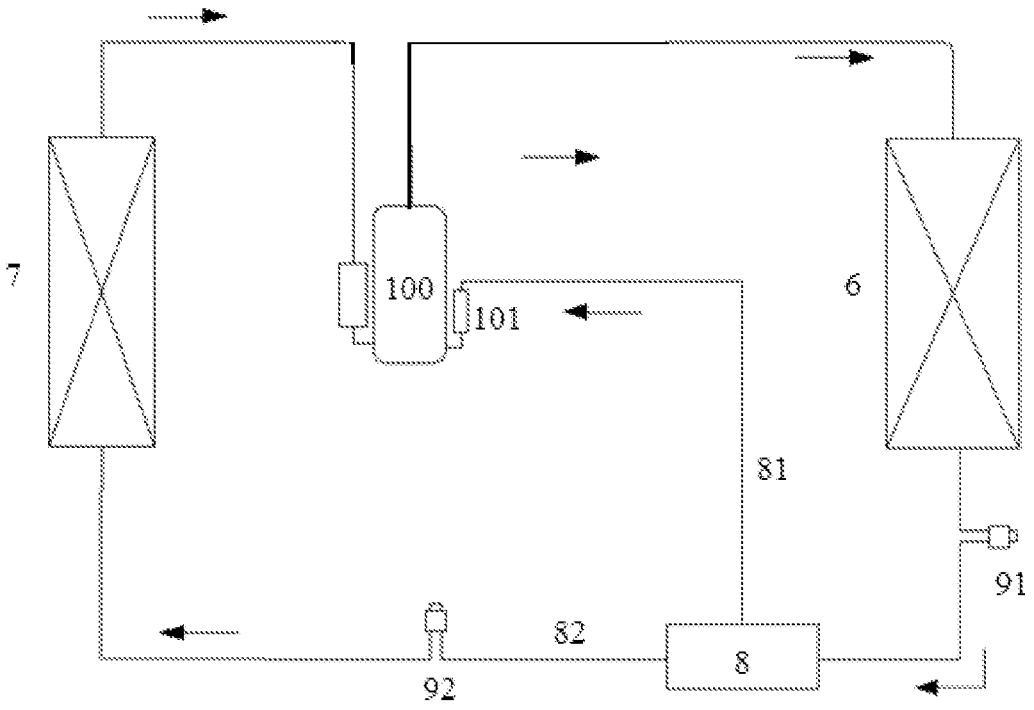
FIG. 9 is another circular system view showing a third alternative embodiment of the air conditioner having the single-stage enthalpy enhancing rotary compressor in FIG. 6.

In the second alternative embodiment, as shown in FIG. 8, the vapor injection opening 5 of the compressor 100 may also be provided with a vapor injection reservoir 101 to avoid performance fluctuations. In a third alternative embodiment, as shown in FIG. 9, the four-way valve 200 may be omitted when the air-conditioning system is used as a single cooling machine.

Beneficial Effects:

1. The present disclosure can solve the problem of performance deficiency of the single-compression air-conditioning system under high temperature conditions, and the cooling capacity is greatly improved under the high temperature conditions.
2. The intermediate vapor injection system lowers the exhaust temperature, and the working range is widened from outdoor temperature of 52 degrees celsius to 58 degrees celsius.
3. The compressor only needs to be provided with the vapor injection structure on the basis of the existing compressor. The whole compressor needs no extra control, and only the flash evaporator structure is added. The objective of greatly increasing the cooling capacity under the high temperature conditions can be achieved.

The above descriptions are some embodiments of the present disclosure, but not intended to limit the present disclosure. Any modifications, equivalent replacements, and improvements made within the spirits and principles of the present disclosure shall be within the protection scope of the present disclosure. The above descriptions are some embodiments of the present disclosure. It should be noted that, for those skilled in the art, various improvements and modifications may also be made without departing from the technical principles of the present disclosure. These improvements and modifications are also within the protection scope of the present disclosure.

What is claimed is:

1. A single-stage enthalpy enhancing rotary compressor, comprising at least one single-stage cylinder, a rotator, an upper flange, and a lower flange, wherein:

the rotator is arranged inside the cylinder and is rotatable;

a compression chamber is formed between the rotator and an inner peripheral wall of the cylinder;

a vapor injection opening is defined in at least one of the upper flange and the lower flange, and the vapor injection opening is configured to supply gas outside the compressor to the compression chamber directly;

the cylinder is provided with a sliding vane slot;

a rotation angle of the rotator is calculated from 0°, defined by a position where a sliding vane fully extends into the sliding vane slot;

the vapor injection opening is configured: during a movement of the rotor in one circle, when the rotator rotates to a first preset position range of 135° to 345°, not to be blocked by the rotator, and configured to be automatically opened to open a vapor injection; and the vapor injection opening is further configured: during the movement of the rotor in the one circle, when the rotator rotates to a second preset position range of −15° to 135°, to be blocked by the rotator and to be automatically closed to close the vapor injection;

wherein a complete cycle of the compressor is performed within the first preset position range and the second preset position range.

2. The single-stage enthalpy enhancing rotary compressor of claim 1, wherein:

the cylinder is provided with a suction port, a gas discharging port, and a sliding vane slot;

the suction port and the gas discharging port are located by two sides of the sliding vane slot, respectively; and a position of the vapor injection opening is arranged and located at a side of the cylinder proximate to the suction port with respect to the gas discharging port.

3. The single-stage enthalpy enhancing rotary compressor of claim 2, wherein:

in a counterclockwise rotation direction towards the suction port, a position of the sliding vane slot is defined as a rotation angle of 0°, and the vapor injection opening is disposed within a range from 67° to 87°.

4. The single-stage enthalpy enhancing rotary compressor of claim 2, wherein in a counterclockwise rotation direction towards the suction port, a position of the sliding vane slot is defined as a rotation angle of 0°, and the vapor injection opening is disposed within a range from 83° to 103°.

5. The single-stage enthalpy enhancing rotary compressor of claim 2, wherein:

the suction port is configured to be closed after the vapor injection opening is fully opened.

6. The single-stage enthalpy enhancing rotary compressor of claim 1, wherein:

a diameter of the vapor injection opening is 2.5 mm or 3.0 mm.

7. The single-stage enthalpy enhancing rotary compressor of claim 1, wherein:

the single-stage enthalpy enhancing rotary compressor is an invariable-frequency compressor.

8. An air conditioner, comprising the single-stage enthalpy enhancing rotary compressor of claim 1, a condenser, an evaporator, a flash evaporator, and a first-stage throttling device, wherein:

the first-stage throttling device is arranged in a pipeline between the condenser and the flash evaporator;

the flash evaporator is provided with a gas output pipeline and a liquid output pipeline; and the gas output pipeline is in communication with the vapor injection opening of the compressor, and the liquid output pipeline is in communication with the evaporator.

9. The air conditioner of claim 8, wherein:

the liquid output pipeline is further provided with a second-stage throttling device or a straight pipe; and an outlet of the compressor is further provided with a four-way valve.

10. The air conditioner of claim 8, wherein:

the liquid output pipeline is further provided with a second-stage throttling device or a straight pipe.

11. The air conditioner of claim 8, wherein:

an outlet of the compressor is further provided with a four-way valve.

* * * * *